US007121006B2

(12) United States Patent
Sun

(10) Patent No.: US 7,121,006 B2
(45) Date of Patent: Oct. 17, 2006

(54) ART DESIGN KNIFE

(76) Inventor: Fu-Cheng Sun, No. 126, Pao Chung Road, Hsin Tien City, Taipei Hsien (TW)

( * ) Notice: Subject to any disclaimer, the term of this patent is extended or adjusted under 35 U.S.C. 154(b) by 40 days.

(21) Appl. No.: 10/992,794

(22) Filed: Nov. 22, 2004

(65) Prior Publication Data

US 2006/0107532 A1 May 25, 2006

(51) Int. Cl.
*B26B 1/08* (2006.01)

(52) U.S. Cl. ..... 30/162; 30/125; 30/340

(58) Field of Classification Search ..... 30/151–162, 30/283–288, 293, 295, 335; 7/118
See application file for complete search history.

(56) References Cited

U.S. PATENT DOCUMENTS 4,509,260 A * 4/1985 Gringer ..... 30/162
6,374,497 B1 * 4/2002 Sun ..... 30/162
6,446,340 B1 * 9/2002 Ping ..... 30/125
6,742,260 B1 * 6/2004 Hsu ..... 30/162
6,742,261 B1 * 6/2004 Ho ..... 30/162
2004/0163261 A1 * 8/2004 Lin ..... 30/162
2005/0172496 A1 * 8/2005 Zeng ..... 30/151
2005/0283983 A1 * 12/2005 Huang ..... 30/162
2006/0010694 A1 * 1/2006 Chen et al. ..... 30/162

* cited by examiner

*Primary Examiner*—Kenneth E. Peterson
*Assistant Examiner*—Phong Nguyen
(74) *Attorney, Agent, or Firm*—Rosenberg, Klein & Lee

(57) ABSTRACT

An art design knife that provides for enhanced manual gripping stability and safety comprised of a front cover, a rear cover, a hatch, a magazine feed spring, a blade transport component, and a blade magazine. In addition to blade replacement convenience, the blade magazine contains a quantity of spare blades to thereby increase art design knife utility and, furthermore, enhance the industrial practical value of art design knife structures.

1 Claim, 18 Drawing Sheets

ART DESIGN KNIFE

BACKGROUND OF THE INVENTION

1) Field of the Invention

The invention herein relates to precision cutting tools, specifically an art design knife providing for stabler and safer manual utilization that is comprised of a front cover, a rear cover, a hatch, a magazine feed spring, a blade transport component, and a blade magazine. In addition to convenient blade replacement capability, the said blade magazine contains a quantity of spare blades to thereby increase art design knife utility and, furthermore, enhance the industrial practical value of art design knife structures.

2) Description of the Prior Art

Conventional art design knives typically have internally disposed extension and retraction mechanisms, wherein the wear that normally occurs between a keeper spring and single-sided wave-contoured engagement slots diminishes stationary engagement capability, which during utilization results in a loss of blade positioning stability and easily causes serious wounds. Furthermore, since the spare blades of conventional art design knives are kept external to the body of the implement itself, when a blade is to be replaced, a considerable amount of time is often wasted searching for spare blades. In view of the existent shortcomings of the conventional product still awaiting improvement, the inventor of the invention herein based on specialized knowledge and design experience gained by engagement in the related fields conducted extensive research inspired by an original idea that culminated in the successful design of an art design knife of improved structure.

SUMMARY OF THE INVENTION

The primary objective of the invention herein is to provide an art design knife in which the blade transport component is stably and smoothly engaged in detent blocks between a front cover and a rear cover to effectively increase blade immovability and safety. Additionally, the blade magazine of the invention herein contains a quantity of spare blades and is integrated within art design knife to further facilitate blade replacement convenience.

To enable the examination committee to further understand the advantages, objectives, and functions of the present invention, the preferred embodiments of the invention herein are accompanied by the brief description of the drawings below and followed by the detailed description of the invention herein.

DETAILED DESCRIPTION OF THE INVENTION

Figure 1:
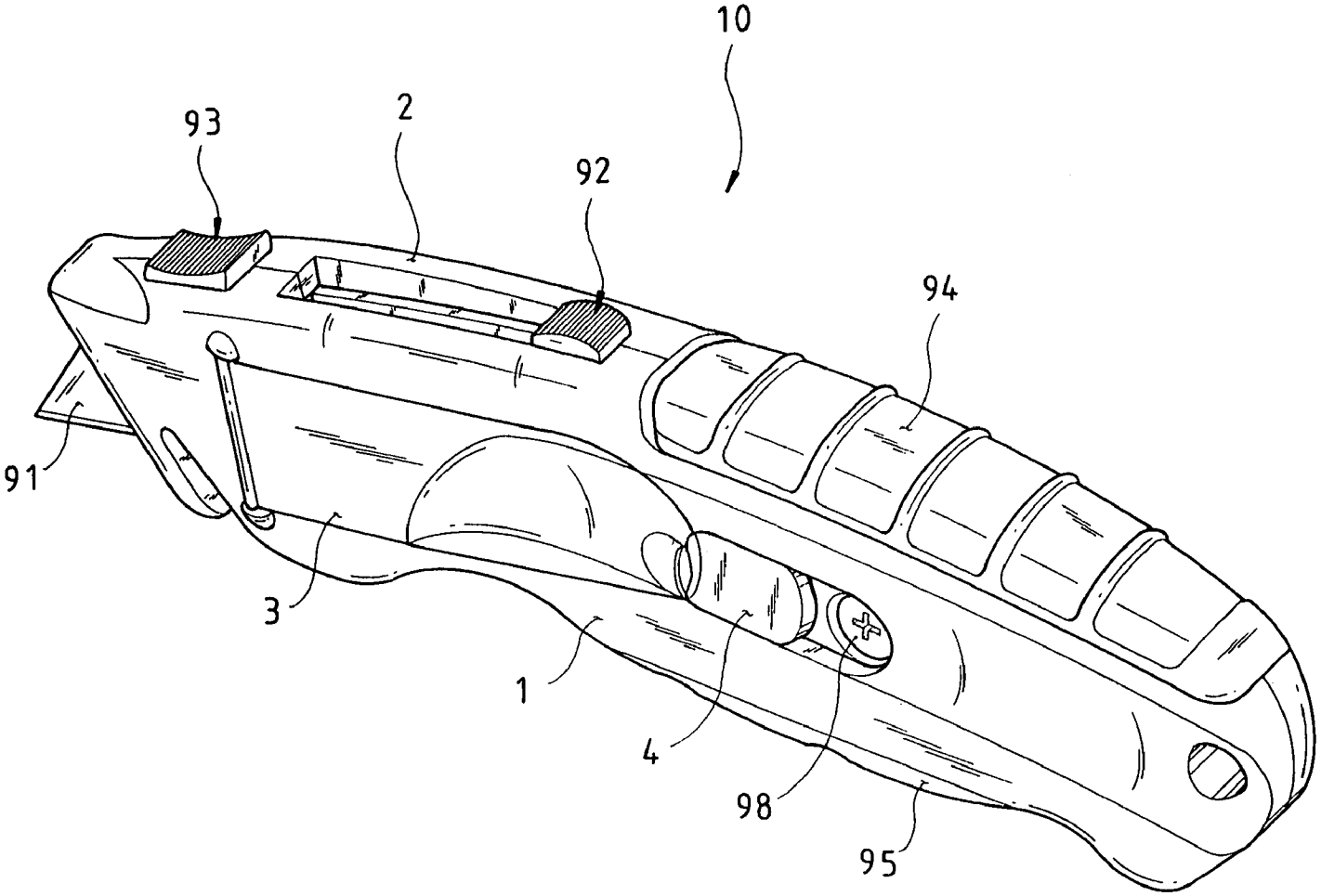
FIG. 1 is an isometric drawing of the invention herein.
Figure 2:
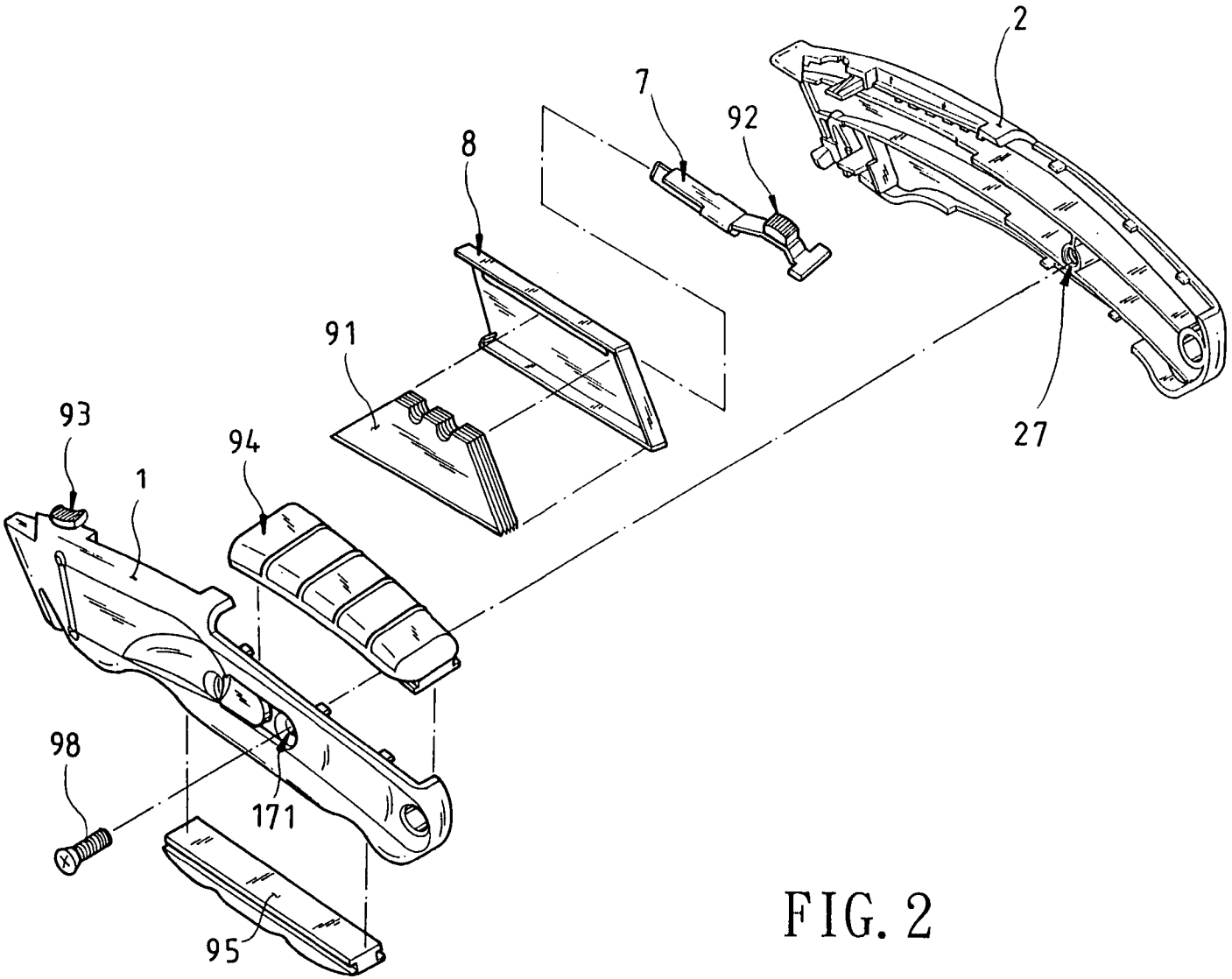
FIG. 2 is an exploded drawing of the invention herein.
Figure 3:
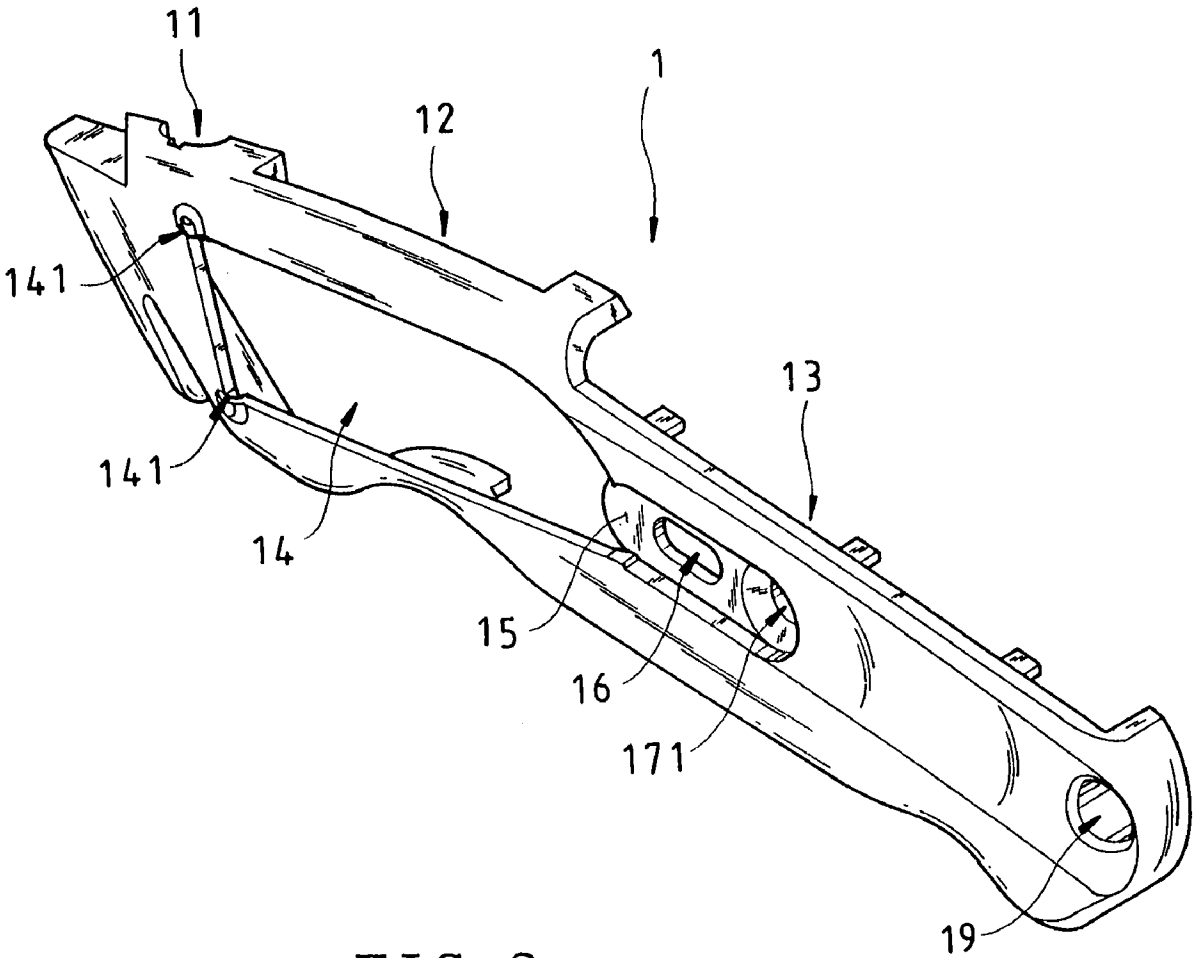
FIG. 3 is an isometric drawing of the front cover 1 of the invention herein, as viewed from an exterior perspective.
Figure 4:
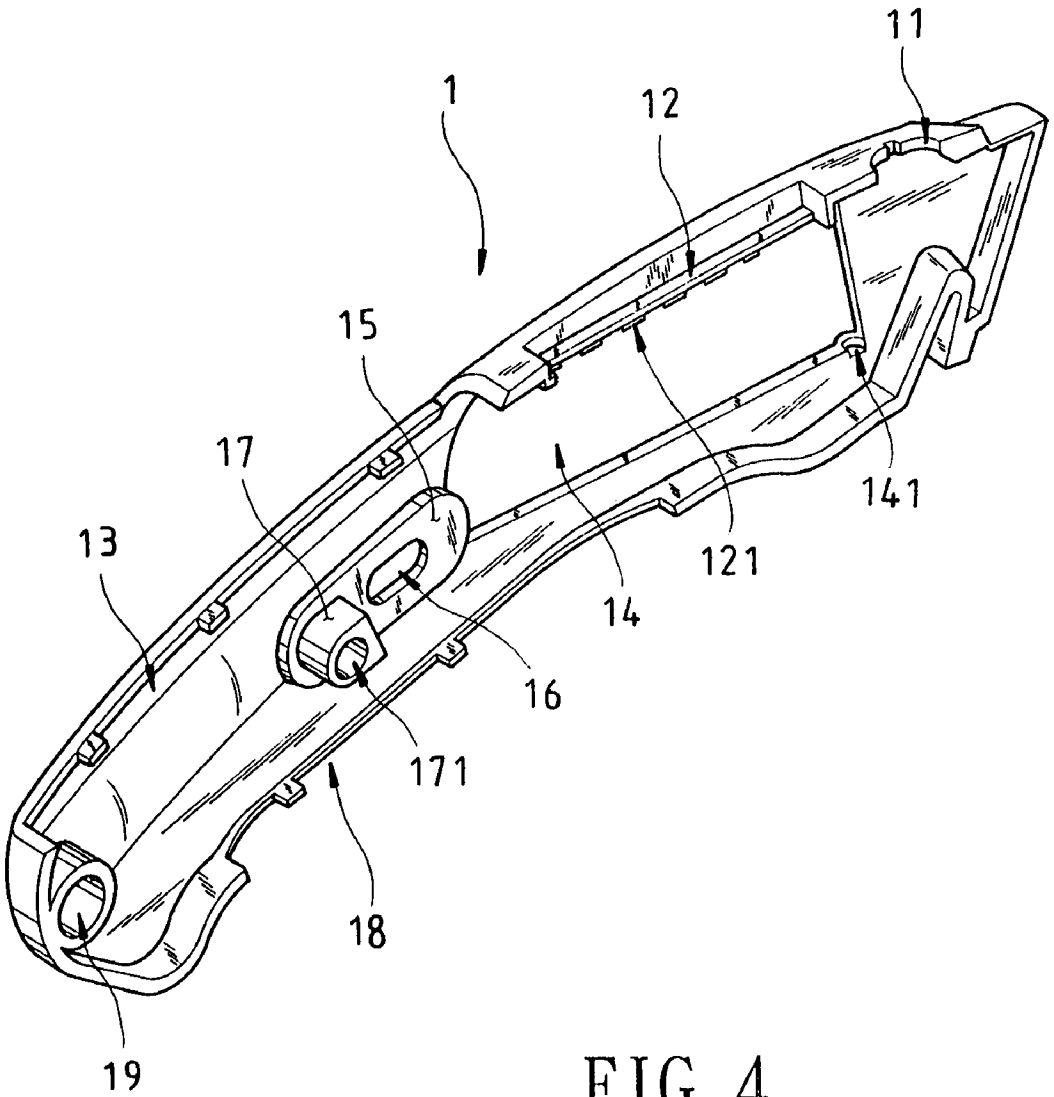
FIG. 4 is an isometric drawing of the front cover 1 of the invention herein, as viewed from an interior perspective.

Referring to FIG. 1 and FIG. 2, the art design knife 10 of the invention herein is comprised of a front cover 1, a rear cover 2, a hatch 3, a hatch lock button 4, a blade transport component 7, a blade magazine 8, blades 91, a push button 92, a blade lock button 93, an upper grip cushion 94, and a lower grip cushion 95, of which:

The front cover 1, referring to FIG. 3 and FIG. 4, the said front cover 1 is a case member of one-piece construction having a semicircular indentation 11 formed in its top anterior section and a slide track indentation 12 disposed along the interior of its top medial section, with the said slide track indentation 12 having a plurality of rectangular detent blocks 121 evenly arrayed along its bottom edge; an elongated indentation 13 is formed in the top posterior section of the said front cover 1 and, furthermore, another elongated indentation 18 is formed at its bottom posterior section; additionally, the said front cover 1 has an opening 14 formed in the side of its anterior section and there are pivot holes 141 disposed at each of two upper and lower corners at the front side of the said opening 14; the said front cover 1 has a oval-shaped reinforcement plate 15 situated at its medial section; an elongated hole 16 is formed at the center of the said reinforcement plate 15 and, furthermore, the said reinforcement plate 15 has a post 17 disposed inside its rear edge and a threaded hole 171 is tapped into the center of the said post 17, and a round hole 19 is formed through the trailing end of the said front cover 1.

Figure 5:
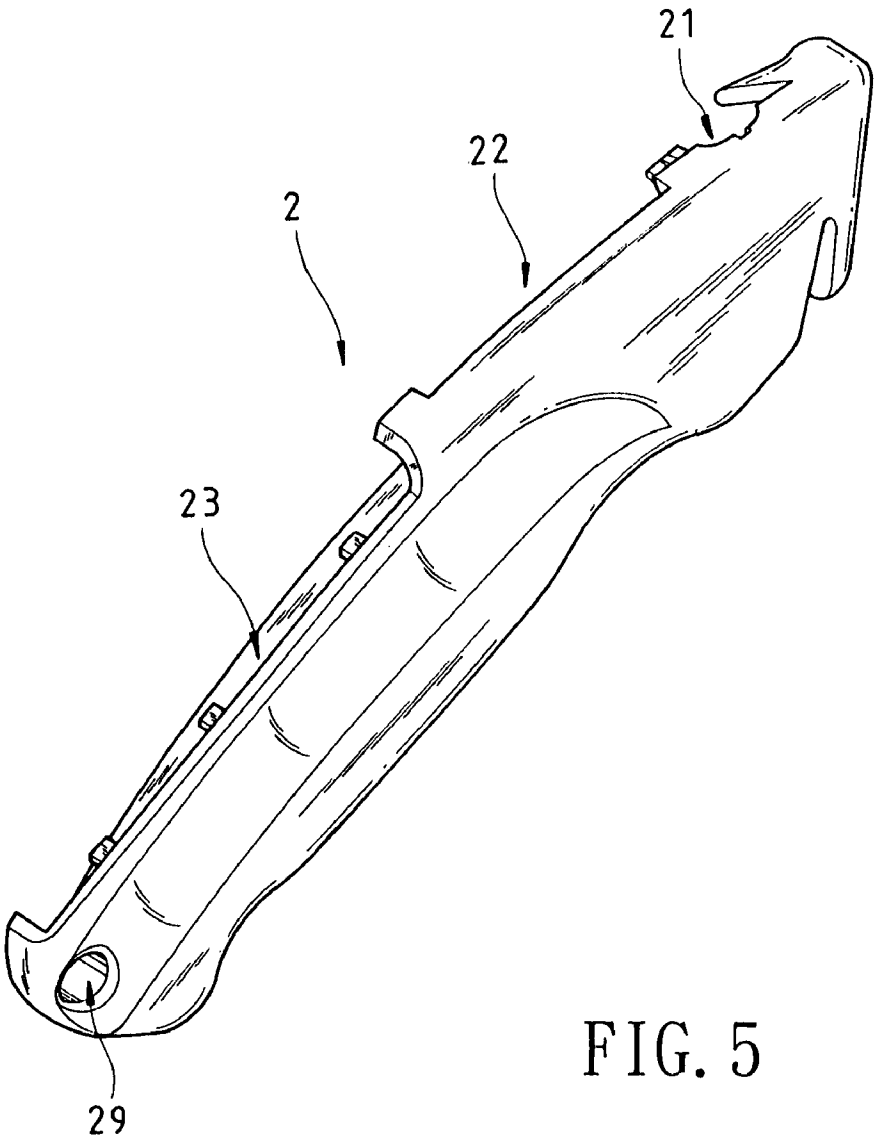
FIG. 5 is an isometric drawing of the rear cover 2 of the invention herein, as viewed from an exterior perspective.
Figure 6:
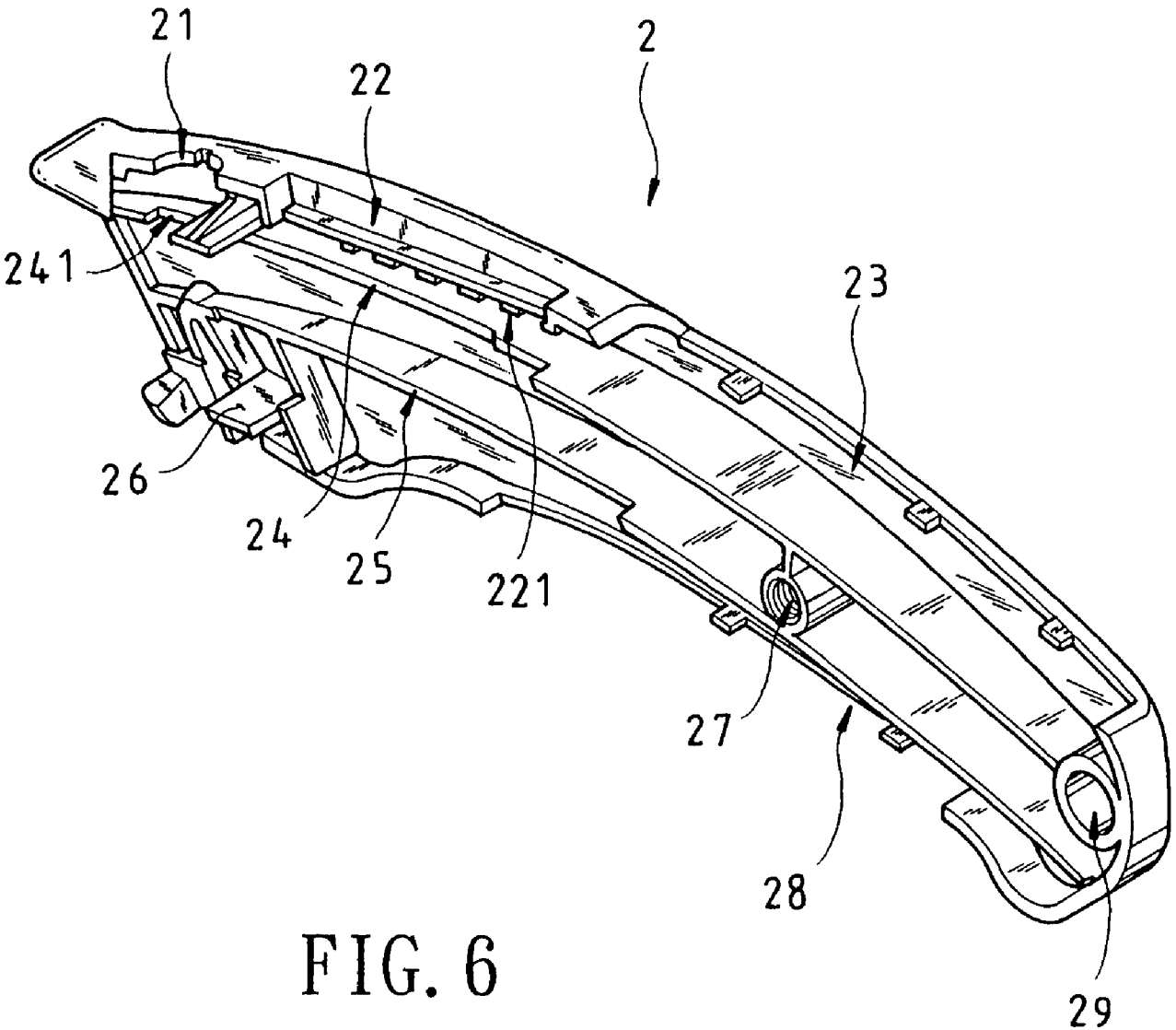
FIG. 6 is an isometric drawing of the rear cover 2 of the invention herein, as viewed from an interior perspective.

The rear cover 2, referring to FIG. 5 and FIG. 6, the said rear cover 2 is a case member of one-piece construction having a semicircular indentation 21 formed in its top anterior section and a slide track indentation 22 disposed along the interior of its top medial section, with the said slide track indentation 22 having a plurality of rectangular detent blocks 221 evenly arrayed along its bottom edge; an elongated indentation 23 is formed in the top posterior section of the said rear cover 2 and, furthermore, another elongated indentation 28 is formed at its bottom posterior section; additionally, the said rear cover 2 has an upper level and lower level abutment plate 24 and 25 protruding along the inside of its anterior section, the said upper level abutment plate 24 has a notch 241 formed in its forward extremity and the said lower level abutment plate 24 has a support element 26 disposed at the lower edge of its front portion; the said rear cover 2 has a threaded mounting hole 27 situated in the center of its posterior section, and a round hole 29 formed through the trailing end of the said rear cover 2.

Figure 7:
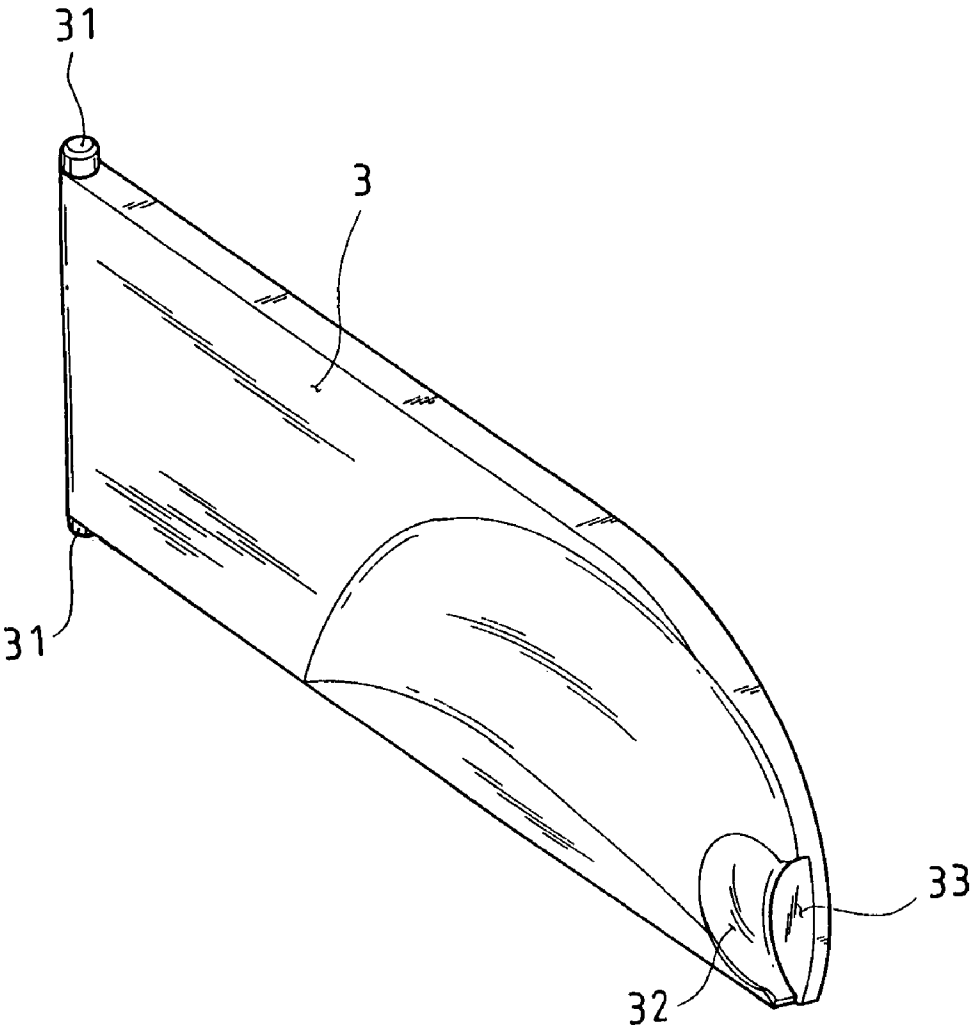
FIG. 7 is an isometric drawing of the hatch 3 of the invention herein, as viewed from an exterior perspective.
Figure 8:
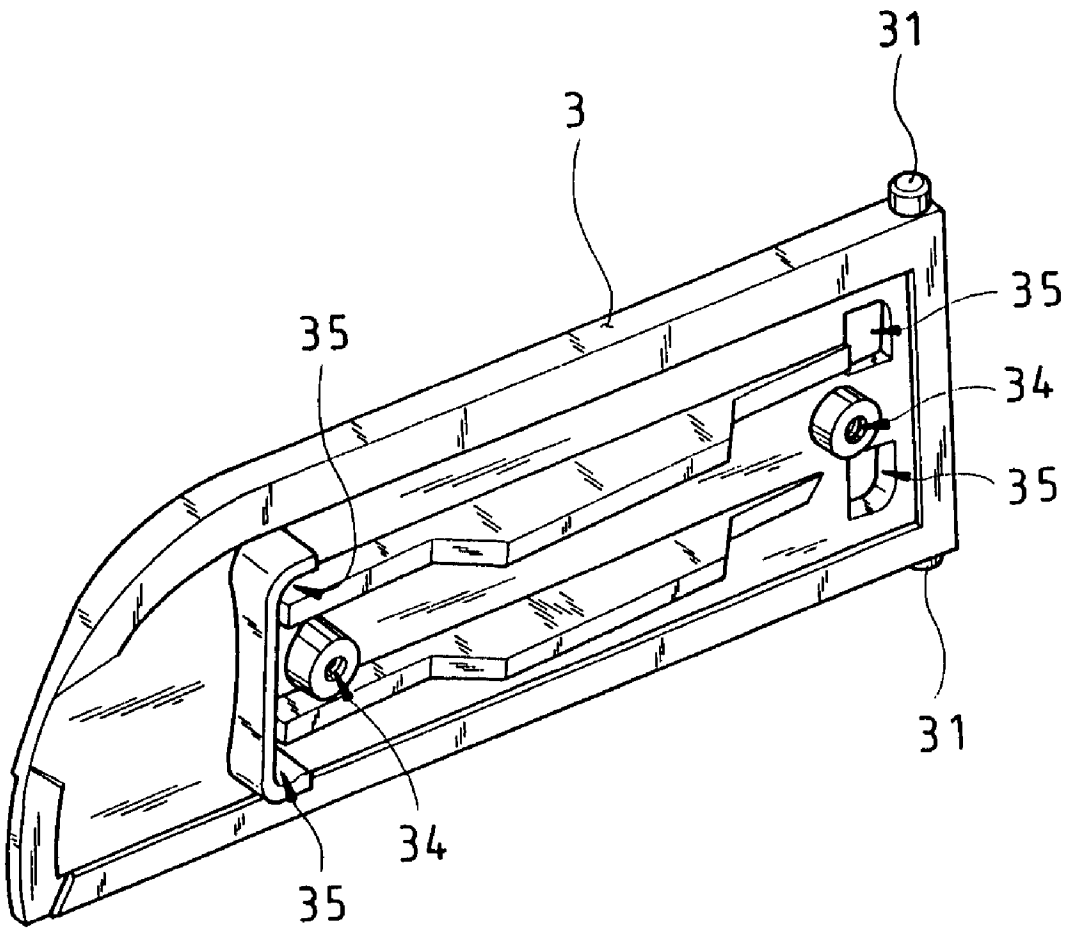
FIG. 8 is an isometric drawing of the hatch 3 of the invention herein, as viewed from an interior perspective.

The hatch 3, referring to FIG. 7 and FIG. 8, is shaped such that it corresponds to the profile of the opening 14 in the said front cover 1 and there are pintles 31 disposed at each of the upper and lower corners at the front side of the said hatch 3; the said front hatch 3 has an arced depression 32 and a securing slot 33 at the outer edge of its rear side; additionally, the said hatch 3 has threaded holes 34 tapped into the front and rear of its interior side and, furthermore, each threaded hole 34 has a curved mounting groove 35 at its upper and lower extent.

Figure 9:
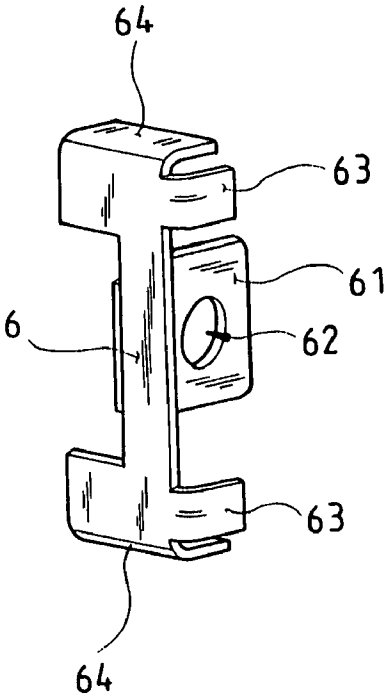
FIG. 9 is an isometric drawing the magazine feed spring mount 6 of the invention herein.

The magazine feed spring mount 6, referring to FIG. 9, has a locating plate 61 at its center and a hole 62 is formed in the said locating plate 61; a retaining brace plate 63 is formed by bending the upper edges at the each of the two ends of the said magazine feed spring mount 6 and, furthermore, a curved footing element 64 is folded at their left and right sides.

Figure 10:
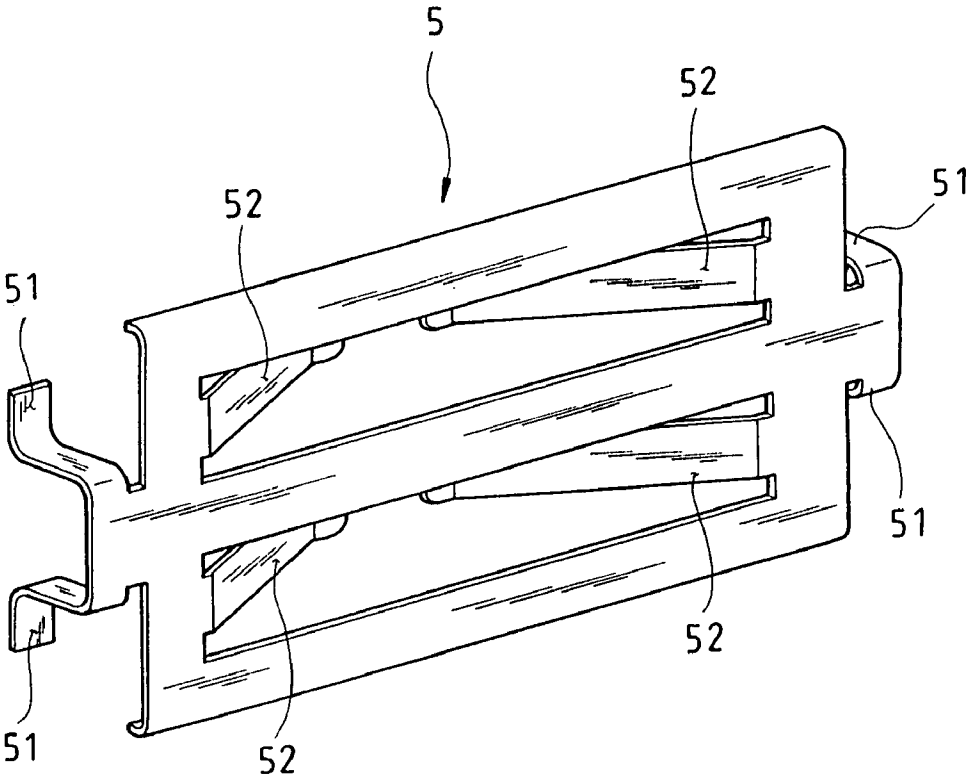
FIG. 10 is an isometric drawing of the magazine feed spring 5 of the invention herein.

The magazine feed spring 5, referring to FIG. 10, is of a pressure stamped metal construction and consists of contact elements 51 fabricated by bending down each of its two left and right sides and then articulating an outward bend at their extremities and, furthermore, punch forming a plurality of flat spring elements 52 postured at a downward angle in the center of the said magazine feed spring 5.

Figure 11:
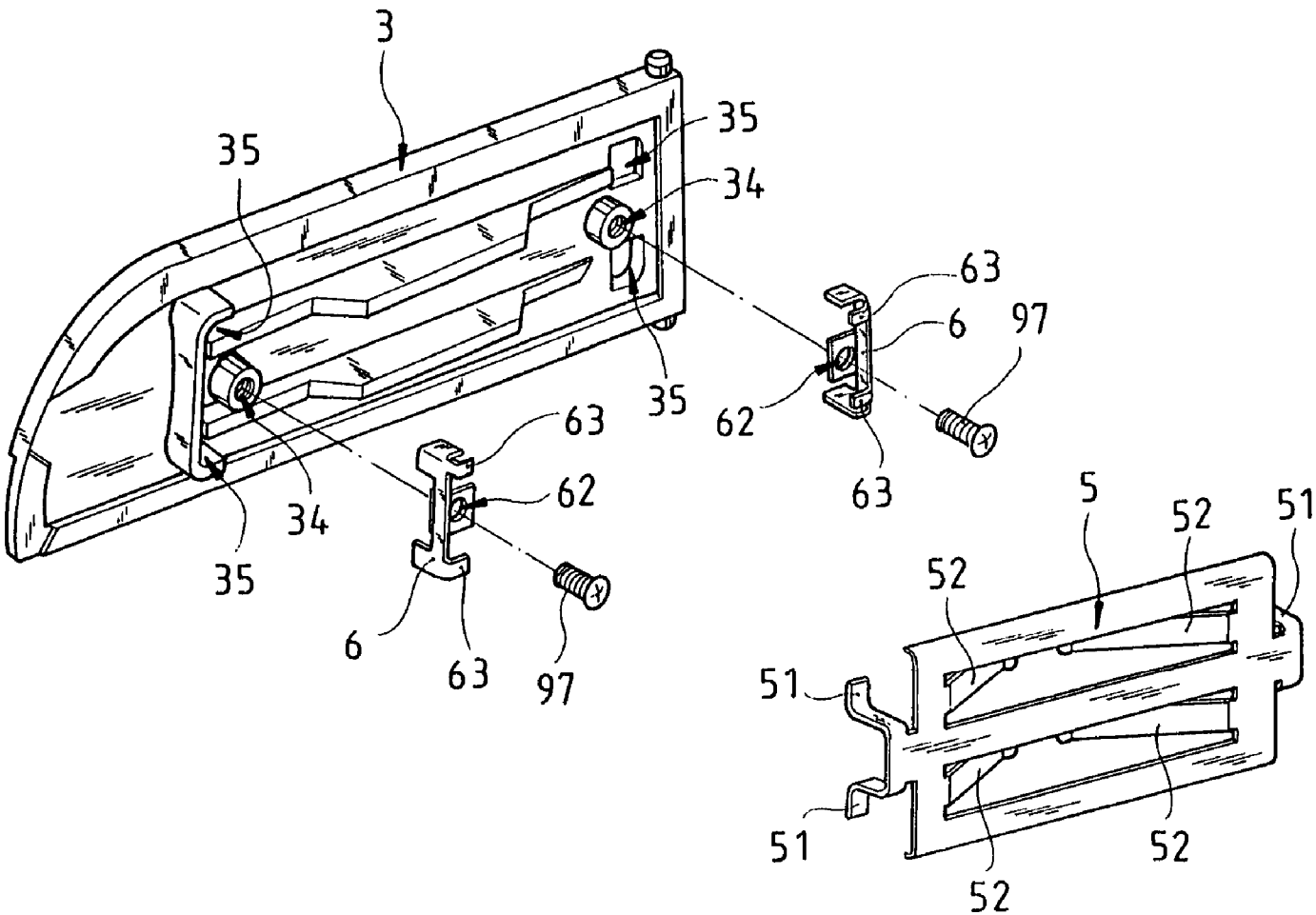
FIG. 11 is an exploded drawing of the hatch 3, the magazine feed spring 5, and the magazine feed spring mount 6 of the invention herein.

As indicated in FIG. 11, two magazine feed spring mounts 6 are first inserted into the curved mounting grooves 35 of the hatch 3 and then a screw 97 is placed into each hole 62 of the magazine feed spring mounts 6 and fastened to the threaded holes 34 of the hatch 3; the contact elements 51 at the two sides of the magazine feed spring 5 are inserted into and ensconced by the retaining brace plates 63 such that the plurality of flat spring elements 52 of the magazine feed spring 5 are forced outward to achieve their function and capability.

Figure 13:
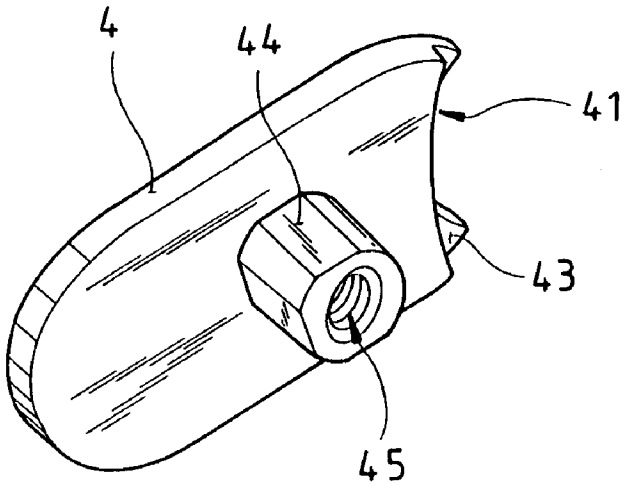
FIG. 13 is an isometric drawing of the hatch lock button 4 of the invention herein, as viewed from an interior perspective.
Figure 12:
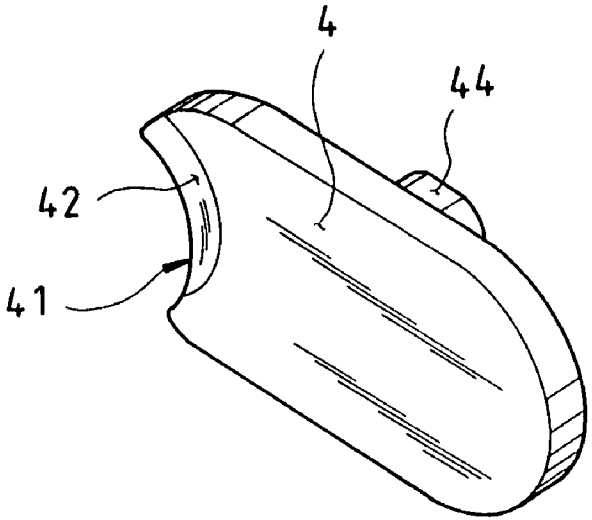
FIG. 12 is an isometric drawing of the hatch lock button 4 of the invention herein, as viewed from an exterior perspective.

The hatch lock button 4, referring to FIG. 12 and FIG. 13, is of an oval shape and has an arced groove 41 and a concavity 42 at one end of its exterior side and a check plate 43 at one end of its interior side; furthermore, the said hatch lock button 4 has a raised block 44 disposed in the center of its interior side and a threaded hole 45 is tapped in the center of the said raised block 44.

Figure 14:
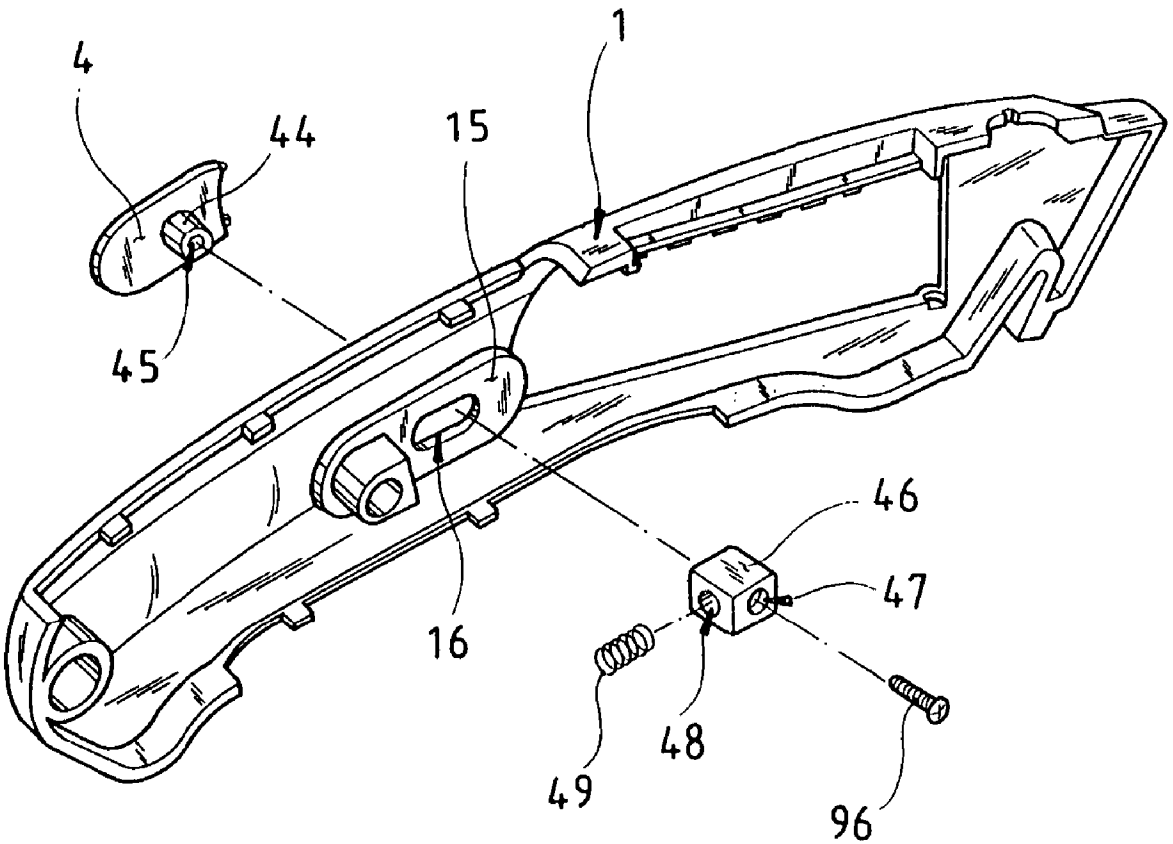
FIG. 14 is an exploded drawing of the front cover 1 and the hatch lock button 4 of the invention herein.

As indicated in FIG. 14, the said mounting block 46 consists of a solid rectangular construct having a threaded hole 47 through one side and a cylindrical recess 48 formed partially through another side, with a coil spring 49 placed into the said cylindrical recess 48; the raised block 44 of the said hatch lock button 4 is inserted into the elongated hole 16 at the center of the front cover 3 reinforcement plate 15, then a screw 96 is placed into the threaded hole 47 of the mounting block 46 and fastened to the hatch lock button 4 by means of the threaded hole 45 in its raised block 44, thereby configuring the coil spring 49 and the mounting block 46 such that the hatch lock button 4 slides back and forth resiliently on the front cover 1 reinforcement plate 15.

Figure 15:
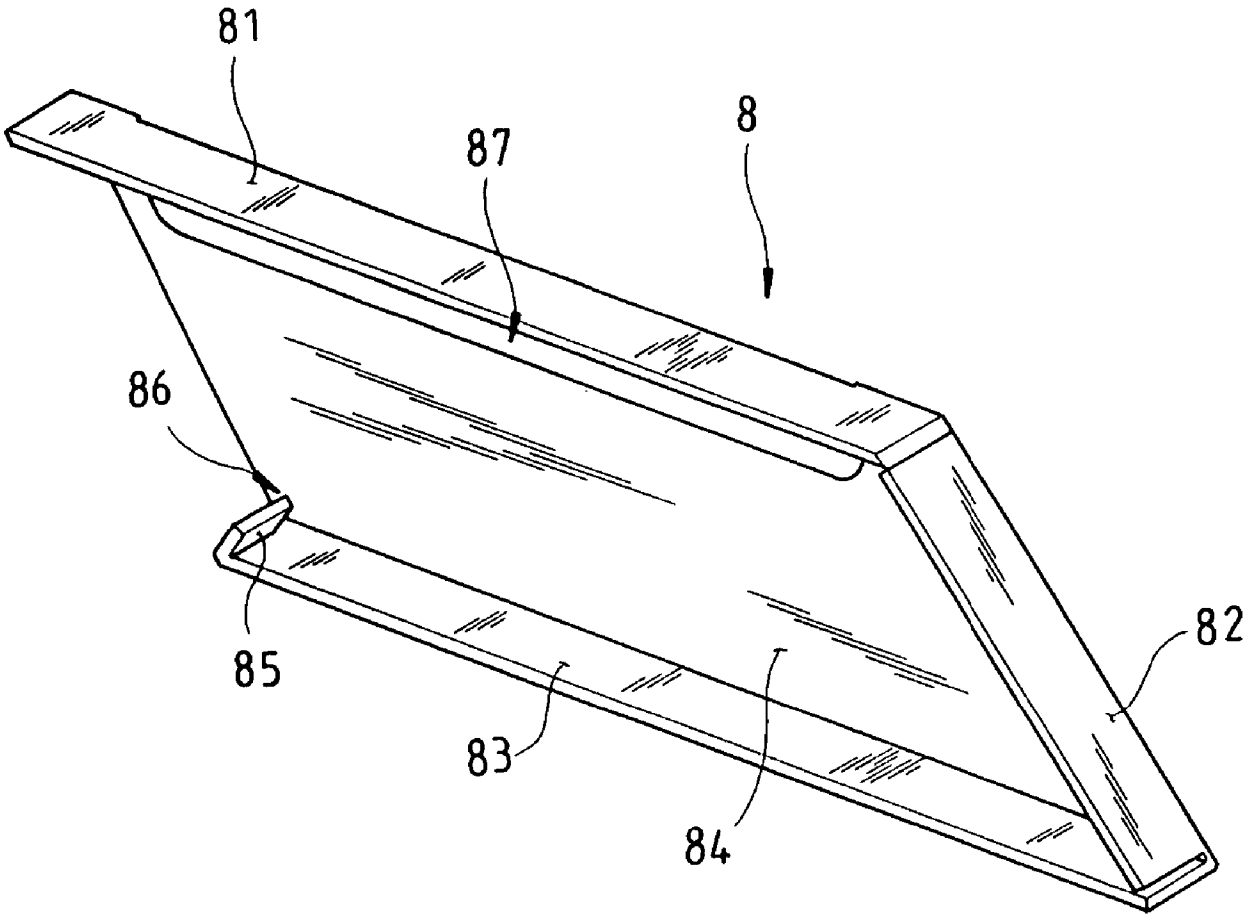
FIG. 15 is an isometric drawing of the blade magazine 8 of the invention herein, as viewed from an interior perspective.
Figure 16:
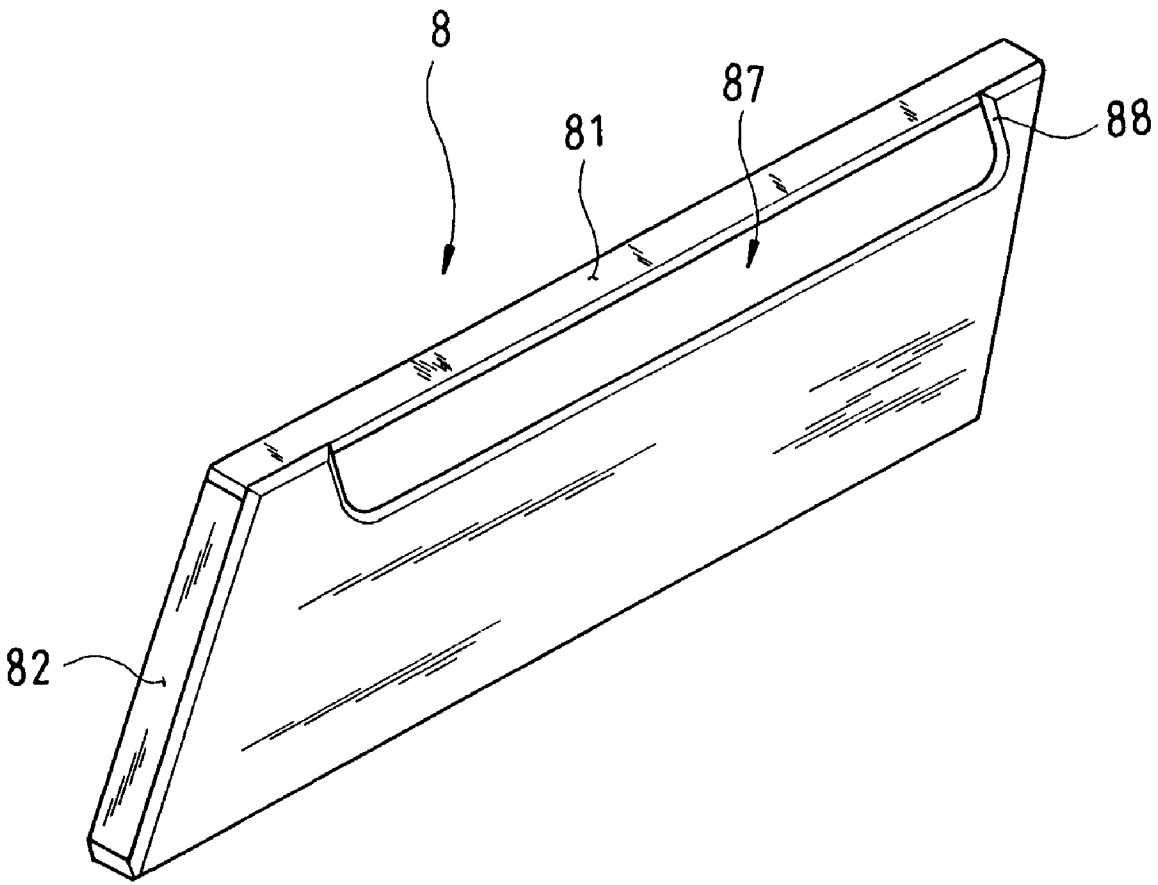
FIG. 16 is an isometric drawing of the blade magazine 8 of the invention herein, as viewed from an exterior perspective.

The blade magazine 8, referring to FIG. 15 and FIG. 16, is a container structure having an upper support member 81, a rear support member 82, and a lower support member 83 respectively disposed on three sides; the interior of the said blade magazine 8 consists of a frame plate 84, a stop tab 85 angled inward at the front edge of the said lower support member 83, and a gap 86 left between the said stop tab 85 and the frame plate 84 that is capable of accommodating the passage of a single blade; additionally, a elongated opening 87 is formed in the said frame plate 84 and there is a beveled face 88 along the front edge of the said elongated opening 87.

Figure 17:
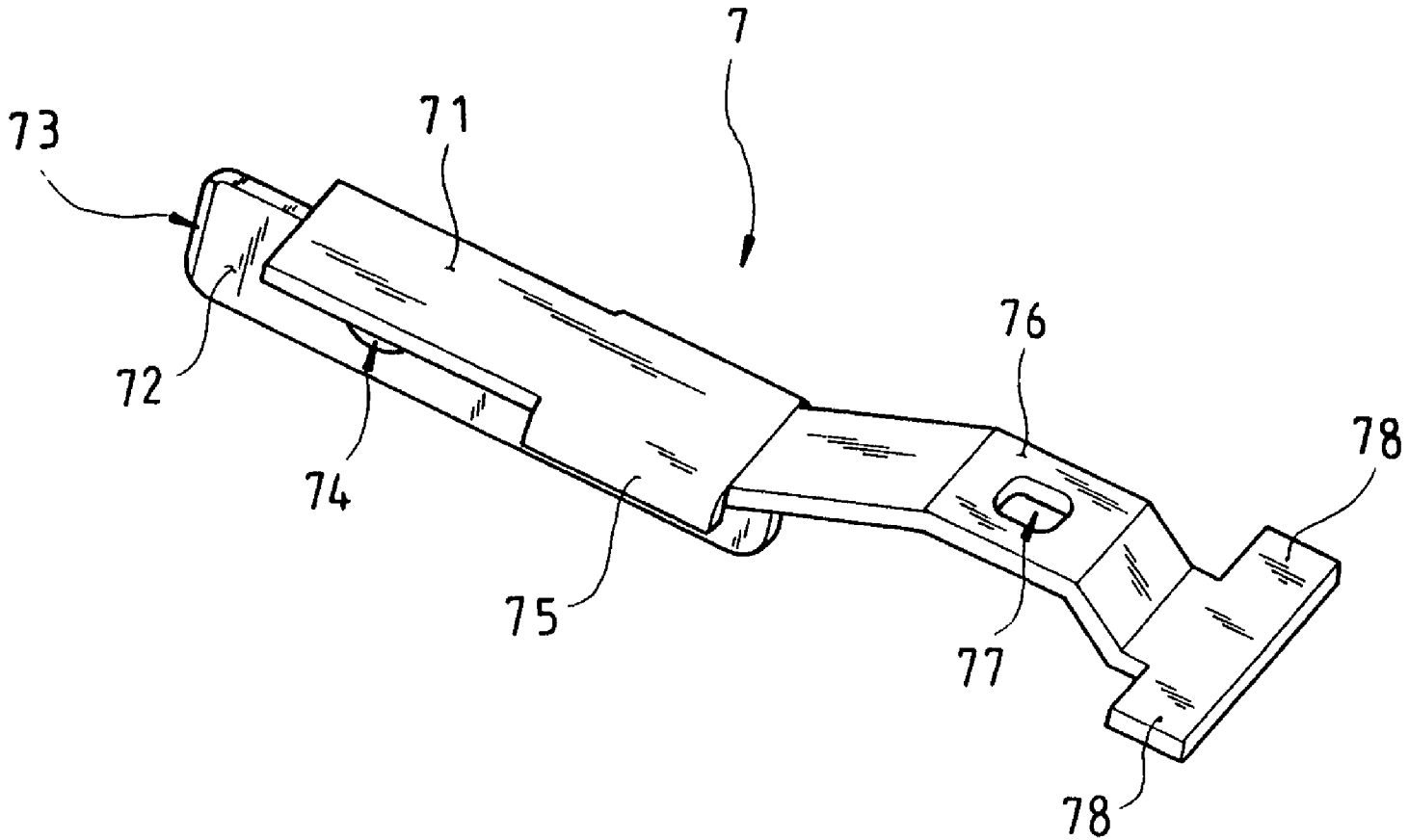
FIG. 17 is an isometric drawing of the blade transport component 7, as viewed from an lateral perspective.
Figure 18:
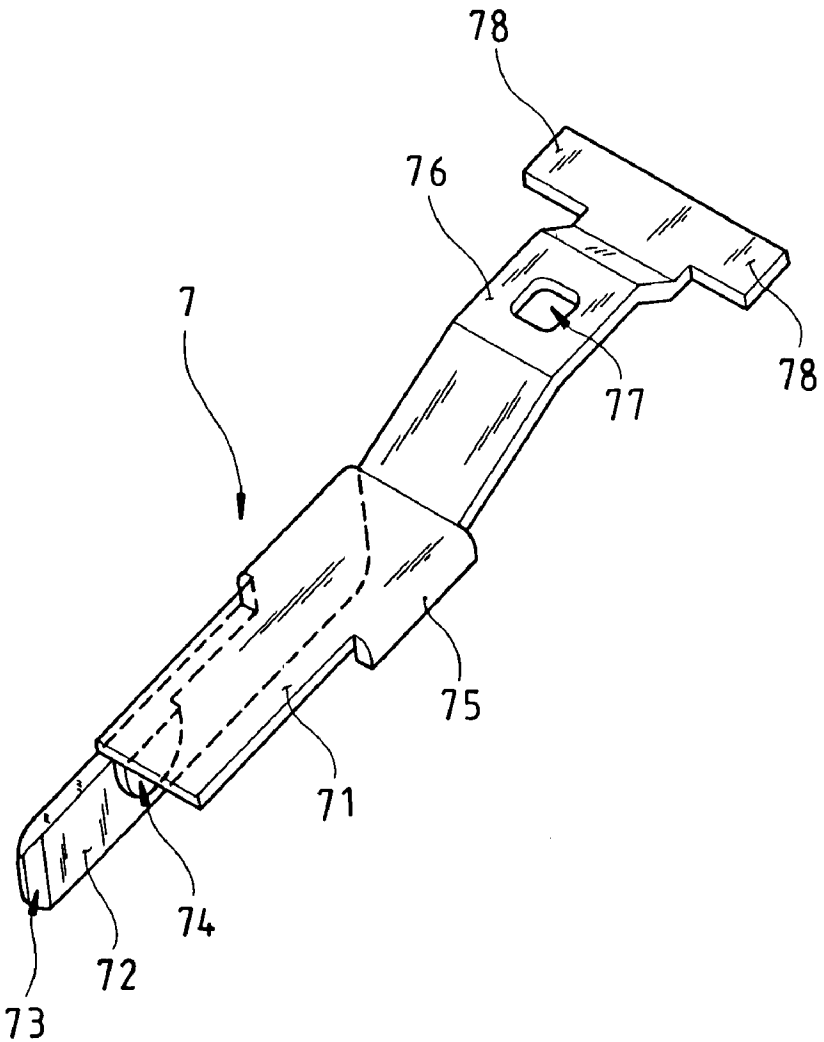
FIG. 18 is an isometric drawing of the blade transport component 7, as viewed from a top perspective.

The blade transport component 7, referring to FIG. 17 and FIG. 18, consists of a sliding support plate 71 horizontally situated at its upper anterior section, a vertical plate 72 along the underside of said sliding support plate 71, with a beveled face 73 on the front edge of the said vertical plate 72, an impelling block 74 extending inward from the said vertical plate 72 near the center of the said sliding support plate 71, and a lip 75 formed along the rear section at the other side of the said sliding support plate 71; additionally, the said blade transport component 7 has a push button support plate 76 at the upper edge of its rear section, a fastening hole 77 is formed in the center of the said push button support plate 76 and, furthermore, the said blade transport component 7 also consists of two positioning tabs 78 extending outward from its rear section.

The said blades 91 consist of a quantity of orderly stacked individual blades that are placed inside the said blade magazine 8; the said push button 92 has a protruding post at its bottom aspect that is inserted and fixed in the fastening hole 77 of the blade transport component 7; the said blade transport component 7 is brought against the top edge of the blade magazine 8 and, at the same time, the blade transport component 7 and the blade magazine 8 are placed into the abutment plates 24 and 25 of the rear cover 2; additionally, the blade lock button 93 is secured into the semicircular indentation 11 in the upper edge of the front cover 1, the said upper grip cushion 94—a one-piece component constructed of a soft plastic material—is secured into the elongated indentation 13 formed in the top posterior section of the front cover 1, the said lower grip cushion 95—also a one-piece component constructed of a soft plastic material—is secured in the elongated indentation 18 formed in the bottom posterior section of the front cover 1 and, furthermore, the two pintles 31 of the said hatch 3 are movably conjoined to the pivot holes 141 of the front cover 1, the hatch 3 is closed over the front cover 1 opening 14, and the hatch lock button 4 is engaged into the front cover 1; the front cover 1 and the rear cover 2 are then placed together and a screw 98 is inserted through the threaded hole 171 of the front cover 1 and fastened to the threaded mounting hole 27 inside the rear cover, thereby enabling assembly into a complete art design knife structure.

Figure 19:
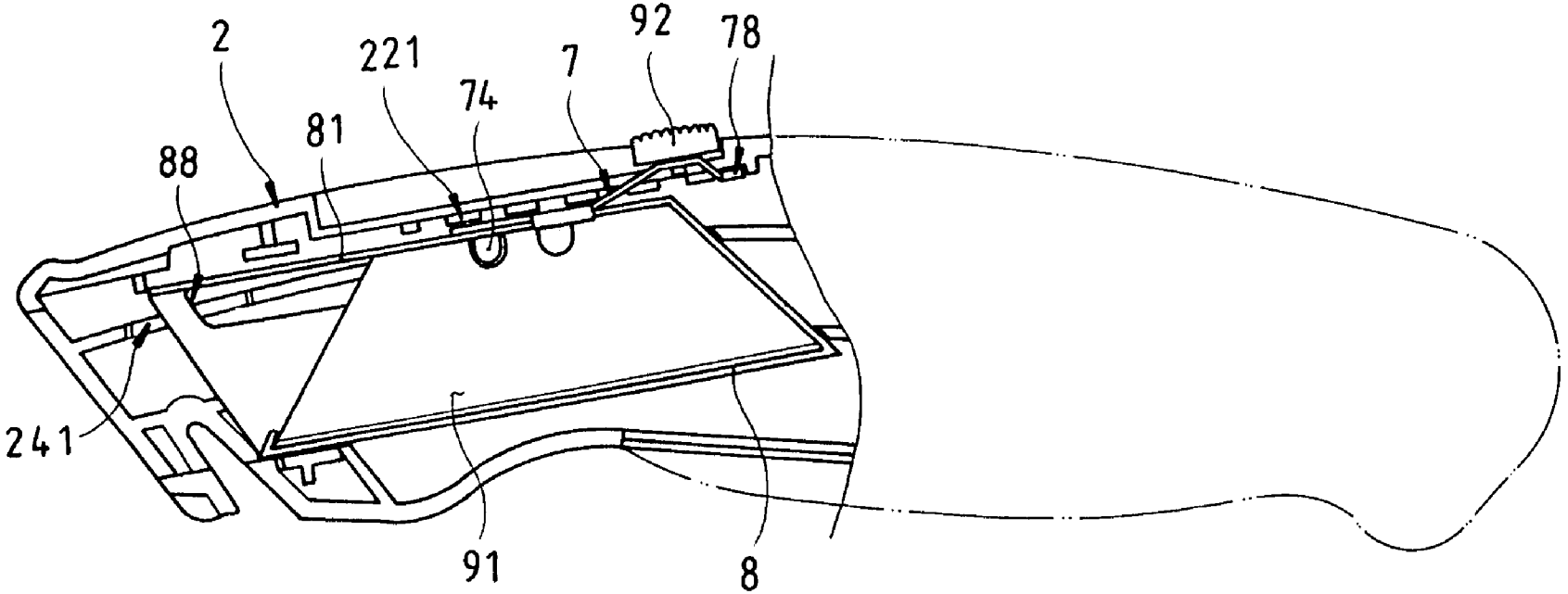
FIG. 19 is a partial cross-sectional drawing of the invention herein when the blade is in the retracted state.
Figure 20:
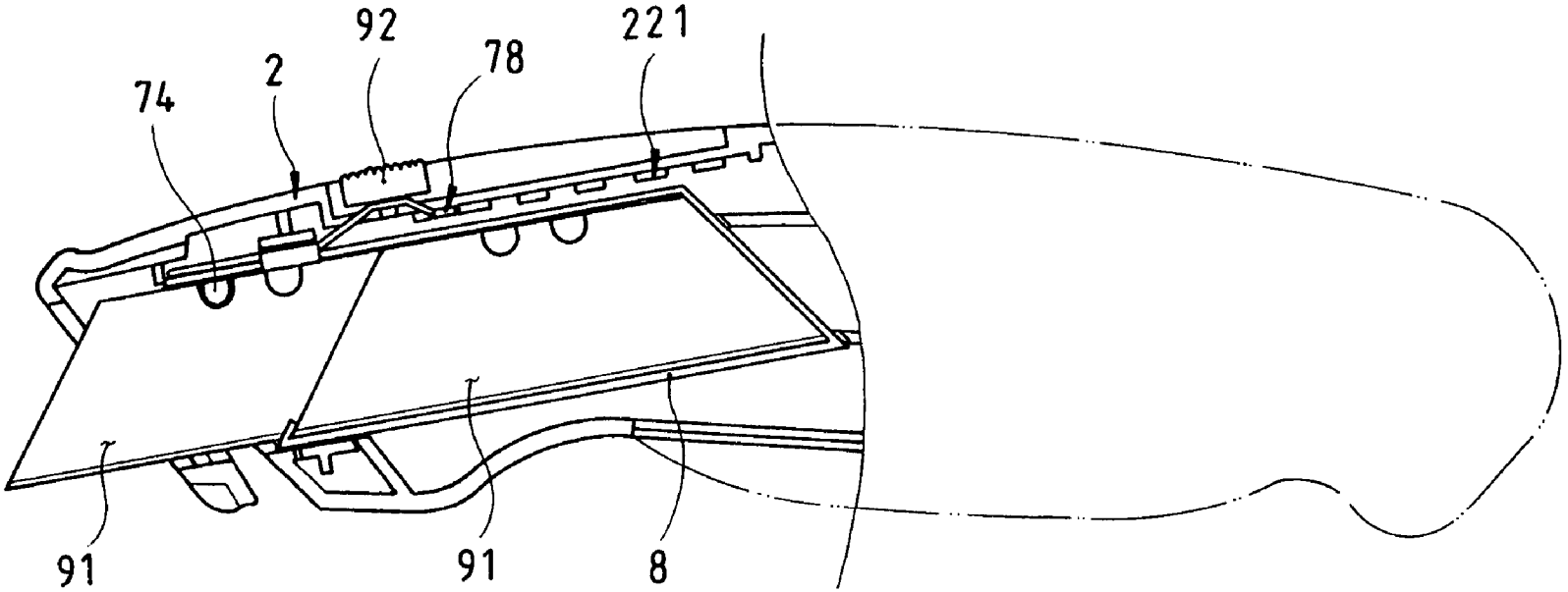
FIG. 20 is a partial cross-sectional drawing of the invention herein when the blade is in the extended state.

As indicated in FIG. 19 and FIG. 20, the positioning tabs 78 at the rear section of the blade transport component 7 of the invention herein engage a notch among the plurality of detent blocks 221 arrayed in the rear cover 2 and when the push button 92 is depressed, the positioning tabs 78 at the rear section of the blade transport component 7 are moved downward and become disengaged from the rear cover 2 detent blocks 221, following which the button 92 is pushed outward horizontally such that the push button 92 causes the blade transport component 7 and a blade 91 to slide outward, with the push button 92 released when the blade 91 has slid to an appropriate position; the said push button 92 returns upward upon release due to the elasticity of the blade transport component 7 and the positioning tabs 78 simultaneously ascend to engage a notch among the plurality of detent blocks 221 along the rear cover 2, thereby achieving a safe and stable blade forwarding operation; to retract the blade 91, the push button 92 is utilized to perform the reverse of the said procedure.

To replace blades, the said push button 92 is pressed outward to the very front end, at which time the beveled face 73 along the forward interior side of the said blade transport component 7 vertical plate 72 slides into contact with the beveled face 88 along the front edge of the blade magazine 8 elongated opening 87 and with the vertical plate 72 of the blade transport component 7 consequently moved outward, the said impelling block 74 is disengaged from the notch in the upper edge of the blade 91, thereby ejecting the blade 91; the remaining quantity of orderly stacked blades 91 in the said blade magazine 8 are shoved toward the uppermost blade 91 by the magazine feed spring 5 (not shown in the drawings) at the interior side of the hatch 3 which also pushes the blades 91 to the lowest level of the blade magazine 8, the said blade transport component 7 returns in the opposite direction and the impelling block 74 engages the notch in the upper edge of the next blade 91, thereby completing the blade replacement operation.

In summation of the foregoing section, since the present invention is capable of achieving its claimed objectives and, furthermore, the disclosed structure possesses exceptional practical value and functions, the invention herein is submitted to the examination committee for review and the granting of the commensurate patent rights.

The invention claimed is:

1. An art design knife comprised of a front cover, a rear cover, a hatch, a hatch lock button, a blade transport component, a blade magazine, blades, a push button, a blade lock button, an upper grip cushion, and a lower grip cushion, of which:

said front cover is a case member of one piece construction having a semicircular indentation formed in a top of an anterior section thereof and a slide track indentation disposed along an interior of a top of a medial section thereof, said slide track indentation having a plurality of rectangular detent blocks evenly arrayed along a bottom edge of said front cover; an elongated indentation is formed in a top posterior section of said front cover and another elongated indentation is formed at a bottom of a posterior section thereof; the said front cover having an opening formed in a side of said anterior section and pivot holes disposed at each of two upper and lower corners at a front side of said opening; said front cover having a oval-shaped reinforcement plate situated at said medial section; an elongated hole being formed at a center of said reinforcement plate and said reinforcement plate having a post disposed inside a rear edge thereof and a threaded hole being tapped into a center of said post, and a round hole being formed through a trailing end of said front cover, said rear cover being a case member of one-piece construction having a semicircular indentation formed in a top of an anterior section thereof and a slide track indentation disposed along an interior of a top of a medial section thereof, with said slide track indentation having a plurality of rectangular detent blocks arrayed along a bottom edge thereof; an elongated indentation being formed in a top of a posterior section of said rear cover and another elongated indentation being formed at a bottom of a posterior section thereof; said rear cover having an upper level and a lower level abutment plate protruding along an inside of said anterior section of said rear cover, said upper level abutment plate having a notch formed in a forward extremity thereof and said lower level abutment plate having a support element disposed at a lower edge of a front portion said rear cover; said rear cover having a threaded mounting hole situated in a center of said posterior section thereof, and a round hole formed through a trailing end of said rear cover;

said hatch being shaped such that it corresponds to a profile of said opening in said front cover and pintles being respectively disposed at each of upper and lower corners at a front side of said hatch; a front of said hatch having an arced depression and a securing slot at an outer edge of a rear side thereof; said hatch having threaded holes tapped into a front and a rear of an interior side thereof and each said threaded hole having a curved mounting groove at an upper and a lower extent thereof;

a magazine feed spring mount having a locating plate at a center thereof and a hole being formed in said locating plate; a retaining brace plate being formed by bending upper edges at each of two ends of said magazine feed spring mount and a curved footing element being folded at their left and right sides;

a magazine feed spring being of pressure stamped metal construction and consisting of contact elements fabricated by bending down each of two left and right sides thereof and then articulating an outward bend at respective extremities thereof and punch forming a plurality of flat spring elements postured at a downward angle in a center of said magazine feed spring;

two magazine feed spring mounts being first inserted into said curved mounting grooves of said hatch and then a screw being placed into each said hole of said magazine feed spring mounts and fastened to said threaded holes of said hatch; said contact elements at two sides of said magazine feed spring each being inserted into and ensconced by said retaining brace plates at an upper extent of said magazine feed spring mounts;

said hatch lock button having an oval shape and an arced groove, said hatch lock button having a concavity at one end of an exterior side thereof and a check plate at one end of an interior side of said hatch lock button; said hatch lock button having a raised block disposed in a center of an interior side thereof and a threaded hole being tapped in a center of said raised block;

a mounting block consisting of a solid rectangular construct having a threaded hole through one side thereof and a cylindrical recess formed partially through another side with a coil spring being placed into said cylindrical recess; said raised block of said hatch lock button being inserted into said elongated hole at said center of said front cover reinforcement plate, a screw being placed into said treaded hole of said mounting block and fastened to said hatch lock button by means of said threaded hole in said raised block;

said blade magazine being a container structure having an upper support member, a rear support member, and a lower support member respectively disposed on three sides; an interior of said blade magazine consisting of a frame plate, a stop tab angled inward at a front edge of said lower support member, and a gap being left between said stop tab and said frame plate for accommodating passage of a single blade therethrough; an elongated opening being formed in said frame plate and a beveled face being formed along a front edge of said elongated opening;

said blade transport component consisting of a sliding support plate horizontally situated at an upper anterior section thereof, a vertical plate along an underside of said sliding support plate, with a beveled face on a front edge of said vertical plate, an impelling block extending inwardly from said vertical plate near a center of said sliding support plate, and a lip formed along a rear section at another side of said sliding support plate; said blade transport component having a push button support plate at an upper edge of a rear section thereof, a fastening hole being formed in a center of said push button support plate and said blade transport component further consisting of two positioning tabs extending outwardly from a rear section thereof;

said blades being a plurality of orderly stacked individual placed inside said blade magazine; said push button having a protruding post at a bottom aspect thereof inserted and fixed in said fastening hole of said blade transport component; said blade transport component being brought against a top edge of said blade magazine and, simultaneous therewith, said blade transport component and said blade magazine being placed into said abutment plates of said rear cover; said blade lock button being secured into said semicircular indentation in an upper edge of said front cover, said upper grip cushion being a one-piece component constructed of a soft plastic material secured into said elongated indentation formed in said top posterior section of said front cover, said lower grip cushion being a one-piece component constructed of a soft plastic material secured in said elongated indentation formed in said bottom of said posterior section of said front cover and, said pintles of said hatch being movably conjoined to said pivot holes disposed at each of two upper and lower corners at said front side of said opening in said front cover, said hatch being closed over said front cover opening, and said hatch lock button being engaged into said front cover; said front cover and said rear cover being placed together and a screw being inserted through said threaded hole of said front cover and fastened to said threaded mounting hole inside said rear cover, thereby enabling assembly into a complete art design knife structure.

* * * * *